US005220354A

United States Patent [19]

Toyosawa et al.

[11] Patent Number: 5,220,354

[45] Date of Patent: Jun. 15, 1993

[54] THERMAL PRINTING HEAD

[75] Inventors: Takeshi Toyosawa; Shuuji Hirano, both of Tokyo, Japan

[73] Assignee: Graphtec Kabushiki Kaisha, Yokohama, Japan

[21] Appl. No.: 806,605

[22] Filed: Dec. 12, 1991

[30] Foreign Application Priority Data

Dec. 18, 1990 [JP] Japan ..... 2-403603[U]
Feb. 22, 1991 [JP] Japan .....48676
Apr. 12, 1991 [JP] Japan .....32690[U]

[51] Int. Cl.[5] ..... B41J 2/335
[52] U.S. Cl. ..... 346/76 PH
[58] Field of Search ..... 346/76 PH; 219/543

[56] References Cited

U.S. PATENT DOCUMENTS 5,072,236 12/1991 Tatsumi et al. ..... 346/76 PH

FOREIGN PATENT DOCUMENTS 0143978 7/1985 Japan .

*Primary Examiner*—Benjamin R. Fuller
*Assistant Examiner*—Huan Tran
*Attorney, Agent, or Firm*—Price, Heneveld, Cooper, DeWitt & Litton

[57] ABSTRACT

The voltage drop in the power supply common conductor of a thermal printing head deteriorates the quality of printing. In order to compensate this voltage drop, the power supply common conductor is provided with multiple feed points. Each feed point is connected through a V-shaped connecting conductor to the power supply.

4 Claims, 5 Drawing Sheets

7: POWER-SUPPLY-SIDE CONDUCTOR

8: GROUND-SIDE CONDUCTOR

10: CONTROL CIRCUITS

7: POWER-SUPPLY-SIDE CONDUCTOR

8: GROUND-SIDE CONDUCTOR

10: CONTROL CIRCUITS

1 : HEAT GENERATING RESISTOR
7 : POWER-SUPPLY-SIDE CONDUCTOR
8 : GROUND-SIDE CONDUCTOR
10 : CONTROL CIRCUITS

THERMAL PRINTING HEAD

BACKGROUND OF THE INVENTION

This invention relates to a thermal printing head, and more particularly to a conductor pattern formed on a ceramic substrate for a thermal printing head.

A heat-resisting glass layer is formed on a ceramic substrate, and on this glass layer, a line of heat generating resistor is formed. A line of power supply common conductor is formed in parallel to the line of the heat generating resistor. Equally spaced power-supply-side conductors are formed originating from the power supply common conductor and intersecting the heat generating resistor in perpendicular direction for making contacts to the heat generating resistor.

Each ground-side conductor is formed intersecting the heat generating resistor at a middle point adjacent two power-supply-side conductors.

This invention relates to the pattern of these conductors, and the background of the invention will be explained in connection with FIG. 5, which shows the circuit diagram of a thermal printing head. In FIG. 5, 1 is heat generating resistor, 2 is shift register, 3 is latch, 4 is driver, 5 is power supply, 60 is power supply common conductor, 7 is power-supply-side conductor, 8 is ground-side conductor. Control circuits 10 are composed of integrated circuits including the shift register 2, the latch 3, and the driver 4.

In accordance with the dot pattern of a line to be printed, a bit pattern in the shift register 2 is arranged. This bit pattern is latched by the latch 3. Each unit of the driver 4 connects the corresponding ground-side conductor 8 to ground in accordance with the logic of the corresponding bit on the latch 3 during the time interval of a strobe signal from control lines.

For example, when a ground-side conductor 8*a* is grounded through the control circuits 10, current flows form the power-supply-side conductors 7*a*, 7*b* to the ground-side conductor 8*a*, and a section indicated by 1*a* of the heat generating resistor 1 is heated.

The operator of the thermal printing equipment naturally wishes to see a part of printing immediately after the printing of the part is finished. In a so-called edge-type thermal printing head, the heat generating resistor 1 is formed near to an edge line of the ceramic substrate so that the printed portion quickly leaves the edge line of the thermal printing head to an open space visible by the operator.

When the heat generating resistor 1 is near to an edge line of the ceramic substrate, only a narrow space is left for the power supply common conductor 60 between the heat generating resistor 1 and the edge line of the substrate.

Narrower width of the power supply common conductor 60 means larger resistance. In heretofore known thermal printing heads, the power supply common conductor 60 is connected to the power supply only at both ends of the conductor 60. Voltages impressed to heat generating sections in the central parts of the heat generating resistor 1 become lower than those impressed to heat generating sections near to both ends because of the voltage drop in the power supply common conductor 60. This difference of impressed voltages deteriorates the quality of printing.

In heretofore known thermal printing heads, there are no means for compensating for the voltage drop in the power supply common conductor 60.

BRIEF DESCRIPTION OF THE INVENTION

Therefore, an object of the present invention is to provide a thermal printing head in which the heat generating resistor is formed near to the edge line of the substrate, and nevertheless the voltage drop in the power supply common conductor has little influence on the quality of printing. For this object, the power supply common conductor is provided with multiple feed points, and each feed point is connected by a V-shaped connecting conductor to the positive terminal of the power supply. These V-shaped connecting conductors are formed on the same side with the ground-side conductors.

The ground-side conductors are divided into several groups, and in each group of the ground-side conductors, the width of the conductors in the direction of the heat generating resistor is converged as the conductors go further away from the heat generating resistor. Because of this convergence, a V-shaped space is left between two groups of ground-side conductors, and a V-shaped connecting conductor is formed on each V-shaped space.

Another object of this invention is to provide the ground-side conductor pattern which is adapted to form the V-shaped space.

Still another object of this invention is to decrease the resistance of the connecting portion between the V-shaped connecting conductor and the power supply common conductor.

BRIEF DESCRIPTION OF THE DRAWINGS

Further objects, features, and advantages of this invention will become apparent from a consideration of the following description, the appended claims, and the accompanying drawings in which the same numerals indicate same or the corresponding parts.

DETAILED DESCRIPTION OF THE PREFERRED EMBODIMENT

Figure 1:
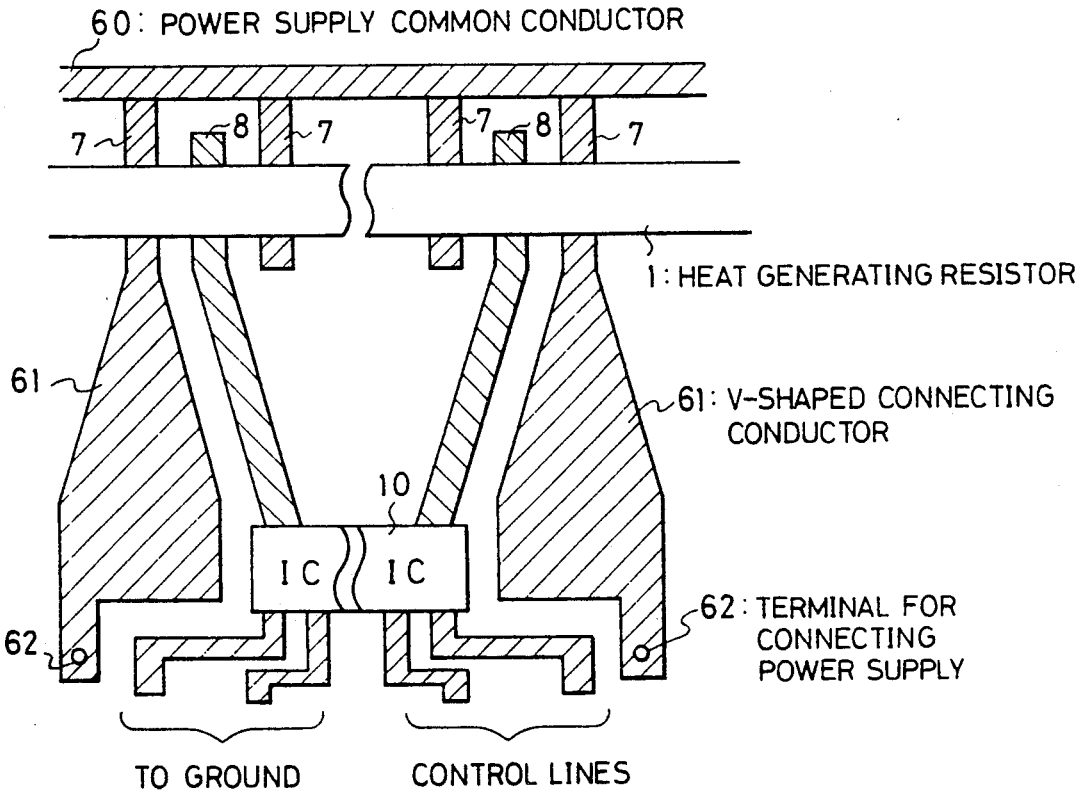
FIG. 1 shows a schematic plan view of an embodiment of this invention.

Referring now to FIG. 1, 1 is heat generating resistor, 7 is power-supply-side conductor, 8 is ground-side conductor, 10 is control circuits, 60 is power supply common conductor, 61 is V-shaped connecting conductor, 62 is terminal for connecting power supply.

Control circuits 10 of a thermal printing head are usually divided into several groups, and each group of control circuits 10 is packed in a chip of integrated circuits (IC) which is shown also by numeral 10 in FIG. 1.

One IC chip 10 has connections to a group of ground-side conductors 8. For the purpose of the following descriptions, the direction of the heat generating resistor 1 is called Y direction. In the present invention, the length of an IC chip 10 in Y direction is made smaller than the extent of the corresponding group of ground-side conductors 8 at the intersections to the heat generating resistor 1. The center of an IC chip 10 is placed at a same position in Y direction with the center of the extent of the corresponding group of the ground-side conductors 8.

The groups of ground-side conductors 8 is so formed as each one ground-side conductor 8 runs in a straight line to the corresponding terminal on the IC chip 10 after the conductor 8 leaves the heat generating resistor 1. Thus, a V-shaped space is left between the adjacent two groups of ground-side conductors 8.

A V-shaped connecting conductor 61 is formed on each V-shaped space between adjacent two groups of ground-side conductors 8.

Each V-shaped connecting conductor 61 is connected to the power supply 5 at a terminal 62, and is connected to the power supply common conductor 60 through a power-supply-side conductor 7.

Figure 5:
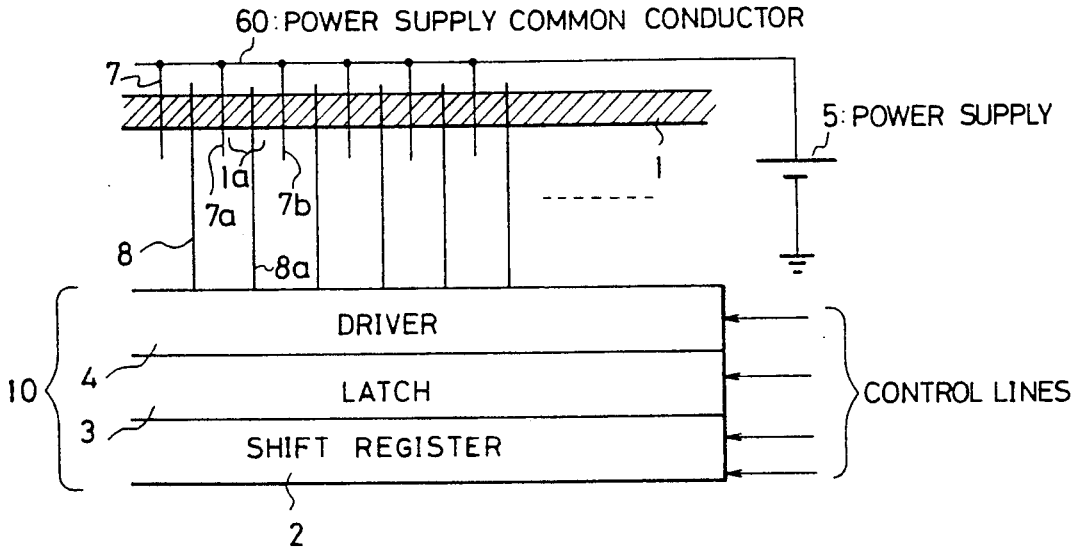
FIG. 5 is a circuit diagram of a thermal printing head.

Thus the power supply common conductor 60 has multiple feed points where the power supply is connected through a V-shaped connecting conductor 61 of relatively uniform resistance. And therefore, the voltage drop in the power supply common conductor 60 has a very little influence on the voltage between a grounded ground-side conductor (for example 8*a* in FIG. 5) and the adjacent power-supply-side conductors 7*a* and 7*b*. In this way, the deterioration of the printing quality is eliminated.

Figure 2:
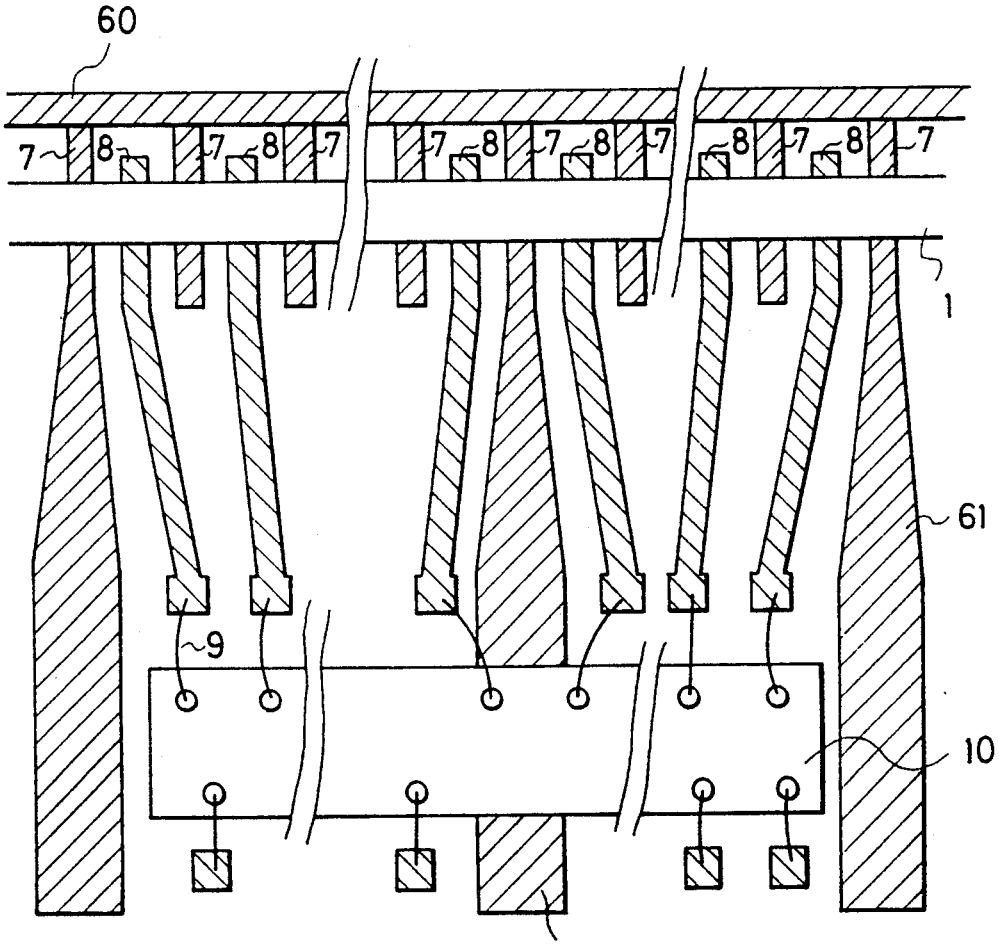
FIG. 2 shows a schematic plan view of another embodiment of this invention.

FIG. 2 shows a schematic plan view of another embodiment of this invention.

In FIG. 2, 9 is bonding wire and 63 is also a V-shaped connecting conductor which is formed beneath the IC chip 10. In a conventional practice of manufacturing a thermal printing head, the power-supply-side conductors 7 and ground-side conductors 8 are formed beneath the heat generating resistor 1, and the V-shaped connecting conductor 63 is easily formed beneath an IC chip 10. In this embodiment, a group of ground-side conductors 8 are further subdivided into plural subgroups, and the extent in Y direction of each subgroup of the ground-side conductors 8 is converged as the conductors 8 approach to the IC chip 10, leaving a V-shaped space between the adjacent two subgroups. The V-shaped connecting conductor 63 is formed on this V-shaped space between the two subgroups.

Figure 3:
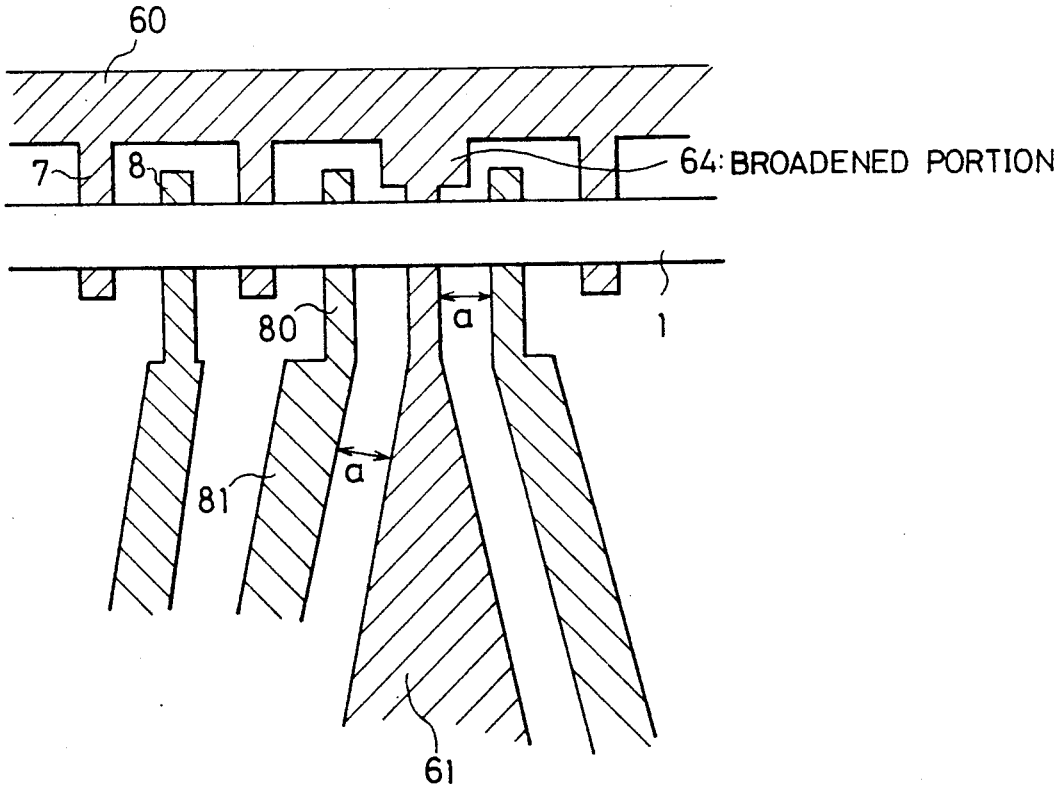
FIG. 3 shows a ground-side conductor pattern adapted to be used in this invention.

Referring now to FIG. 3, there is shown a ground-side conductor pattern in detail. In order to keep printed dot size uniform in Y direction, the spacing of the power-supply-side conductors 7 must be uniform. When a ground-side conductor 8 is placed at the center of the spacing between two power-supply-side conductors 7, the distance "a" as indicated in FIG. 3 is the minimum distance of spacing between a power-supply-side conductor 7 and a ground-side conductor. It is preferred that this minimum distance of spacing be maintained between a V-shaped connecting conductor 61 and a ground-side conductor 8. FIG. 3 shows a ground-side conductor pattern in which this minimum distance "a" of spacing is maintained. The width of the ground-side conductor 8 which is adjacent to a V-shaped connecting conductor 61 is enlarged to the opposite side after the conductor 8 has left the heat generating resistor 1, as shown by numerals 80 and 81 in FIG. 3.

Also a broadened portion 64 is provided between a V-shaped connecting conductor 61 and the power supply common conductor 60. This broadened portion decreases the resistance of the connecting portion between a V-shaped connecting conductor 61 and the power supply common conductor 60.

Figure 4:
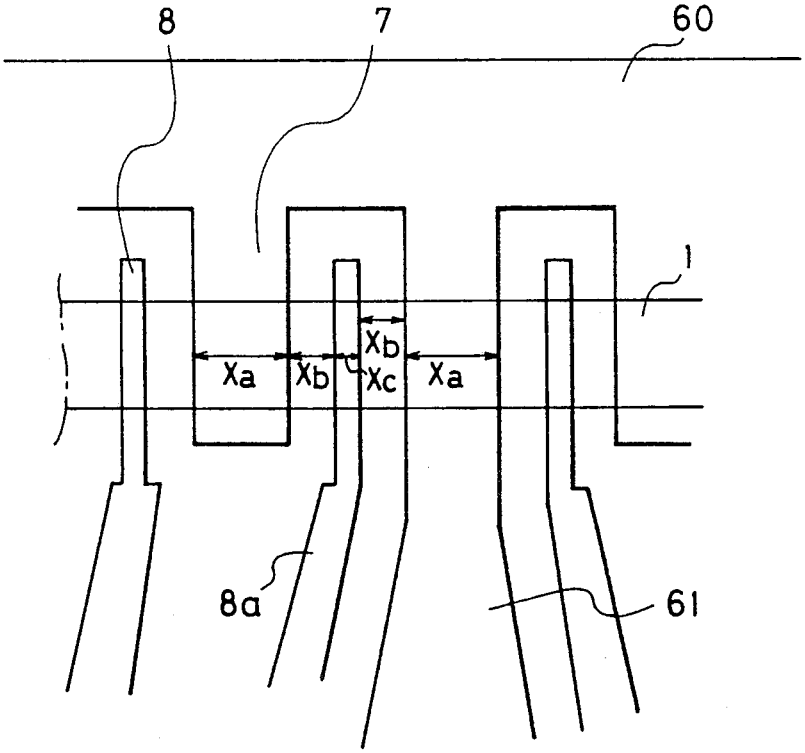
FIG. 4 shows an embodiment of power-supply-side conductor pattern and ground-side conductor pattern adapted to be used in this invention.

Width of a power-supply-side conductor 7 can be made larger than that of a ground-side conductor 8 as shown in FIG. 4. The conductors 7 and 8 which are in contact with the heat generating resistor 1 bypass the current in the resistor 1, and therefore only the two portions indicated by $X_b$ in FIG. 4 are effectively heated when a ground-side conductor 8*a* is grounded. The portion indicated by $X_c$ corresponds to the center constriction of a printed dot, and from a viewpoint of a dot shape, it is preferable that $X_c$ is small.

The portion indicated by $X_a$ corresponds to the overlap between the adjacent two dots, and when $X_a$ is too large, necessary overlaps are not obtained. The value of $X_a$ and $X_c$ are determined in consideration of these factors, and $X_a$ is made as large as allowable in order to decrease the resistance of the connecting portion between a V-shaped connecting conductor 61 and the power supply common conductor 60.

We claim:

1. Thermal printing head comprising:

a ceramic substrate, a heat generating resistor formed in a straight line in Y direction on said substrate, a power supply common conductor formed on said substrate in a straight line in Y direction on one side of said heat generating resistor, equally spaced power-supply-side conductors formed on said substrate, each of said power-supply-side conductors originating from said power supply common conductor and intersecting said heat generating resistor perpendicular to Y direction for making contact with said heat generating resistor, control circuits formed on said substrate on the other side of said heat generating resistor from said power supply common conductor, a plurality of ground-side conductors formed on said substrate, each of said ground-side conductors intersecting said heat generating resistor perpendicular to Y direction at a middle point between adjacent power-supply-side conductors, for making contact with said heat generating resistor, each of said ground-side conductors being connected to a corresponding terminal of said control circuits;

characterized in that:

said ground-side conductors are divided into plural groups, and the control circuits for each group of said plural groups of ground-side conductors are packaged in an integrated circuit having a defined length in Y direction, the length dimension in Y direction of each packaged integrated circuit being smaller than the space between the corresponding group of ground-side conductors where they intersect said heat generating resistor, each of said packaged integrated circuits being centered on said substrate with the center of the corresponding group of ground-side conductors where they intersect said heat generating resistor, each of said ground-side conductors is formed on a shortest path to a corresponding terminal of a control circuit in a packaged integrated circuit, after each of said ground-side conductors has left said heat generating resistor, thus forming a V-shaped space between adjacent ground-side conductors, in each V-shaped space thus formed, a V-shaped connecting conductor is formed which connects a power supply to a power-supply-side conductor between adjacent ground-side conductors.

2. Thermal printing head according to claim 1, where a group of said ground-side conductors is divided into plural subgroups of ground-side conductors, with the ground-side conductors within each of said subgroups converging as said ground-side conductors approach to a corresponding integrated circuit, thus forming a V-shaped space between adjacent subgroups of ground-side conductors, and a V-shaped connecting conductor is formed in each V-shaped space for connecting a power supply to a power-supply-side conductor between adjacent subgroups of ground-side conductors.

3. Thermal printing head according to claim 1, where an outer edge of an exterior ground-side conductor of a group of ground-side conductors or of a subgroup of ground-side conductors lies within an edge line of said power-supply-side conductors at the inter-section to said heat generating resistor, and an edge line of a V-shaped connecting conductor facing toward said exterior ground-side conductor is extended as far a insulation against said exterior ground-side conductor is guaranteed.

4. Thermal printing head according to claim 1, where the width of a power-supply-side conductor at the intersection of said heat generating resistor is made larger than that of a ground-side conductor.

* * * * *

UNITED STATES PATENT AND TRADEMARK OFFICE

CERTIFICATE OF CORRECTION

PATENT NO. : 5,220,354

DATED : June 15, 1993

INVENTOR(S) : Takeshi Toyosawa et al.

It is certified that error appears in the above-indentified patent and that said Letters Patent is hereby corrected as shown below:

column 6, line 8:
"a" should be --as--.

Signed and Sealed this

Seventeenth Day of May, 1994

Bruce Lehman

*Attest:*

BRUCE LEHMAN

*Attesting Officer*

*Commissioner of Patents and Trademarks*